US007690288B2

(12) United States Patent
Calico et al.

(10) Patent No.: US 7,690,288 B2
(45) Date of Patent: Apr. 6, 2010

(54) EXPLOSIVE-DRIVEN ELECTRIC PULSE GENERATOR AND METHOD OF MAKING SAME

(75) Inventors: Steve E. Calico, Fort Worth, TX (US); Shad L. Holt, Lubbock, TX (US); James C. Dickens, Lubbock, TX (US); John W. Walter, Lubbock, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 1066 days.

(21) Appl. No.: 11/148,685

(22) Filed: Jun. 9, 2005

(65) Prior Publication Data

US 2007/0000376 A1 Jan. 4, 2007

(51) Int. Cl.
*F42C 11/02* (2006.01)
*H01L 41/113* (2006.01)
*H02N 2/18* (2006.01)

(52) U.S. Cl. ..... 89/1.14; 102/210; 310/311

(58) Field of Classification Search ..... 89/1.14; 102/209, 210; 310/311, 313 A, 316.01, 316.02, 310/316.03, 318, 319, 320, 323.06, 357, 310/367

See application file for complete search history.

(56) References Cited

U.S. PATENT DOCUMENTS 2,914,686 A * 11/1959 Clements et al. ..... 310/334
3,337,760 A * 8/1967 Allport ..... 310/13
3,390,334 A * 6/1968 Forward ..... 375/239
3,478,231 A * 11/1969 Herlach et al. ..... 310/10
3,522,459 A * 8/1970 Fohl et al. ..... 310/10
3,922,968 A * 12/1975 Conger et al. ..... 102/214
3,956,988 A * 5/1976 Pecksen ..... 102/425
3,985,078 A * 10/1976 Hart et al. ..... 102/207
4,020,765 A * 5/1977 Glass et al. ..... 102/201
4,121,123 A * 10/1978 Crolius ..... 310/10
4,444,119 A * 4/1984 Caponi ..... 102/530
4,511,818 A * 4/1985 Benjamin et al. ..... 310/338
4,594,521 A * 6/1986 Schlicher ..... 310/15
4,680,434 A * 7/1987 Skogmo et al. ..... 200/61.08
4,862,021 A * 8/1989 LaRocca ..... 310/10
4,893,049 A * 1/1990 Bundy et al. ..... 310/338
5,059,839 A * 10/1991 Rose et al. ..... 310/10
5,092,243 A * 3/1992 Hawkins et al. ..... 102/210
5,125,104 A * 6/1992 Ohkawa ..... 455/98

(Continued)

OTHER PUBLICATIONS

*EDO Ceramics EC-64 Lead Zirconium Titanate Piezoelectric Material Data Sheet*, <www.matweb.com/search/SpecificMaterialPrint.asp?bassnum=CEDO05>, visited Jan. 24, 2005.

(Continued)

*Primary Examiner*—Bret Hayes
(74) *Attorney, Agent, or Firm*—Davis Patent Services, LLC

(57) ABSTRACT

An electric pulse generator includes a driver having an outer surface, a receiver, and one or more piezoelectric elements disposed between and in electrical contact with the driver and the receiver. The electric pulse generator further includes an explosive material disposed on the outer surface of the driver. A method of making an electrical pulse generator includes providing one or more piezoelectric elements, a driver, a receiver, and an explosive material and operably associating the explosive material with an outer surface of the driver. The method further includes electrically coupling the one or more piezoelectric elements between the driver and the receiver.

21 Claims, 5 Drawing Sheets

U.S. PATENT DOCUMENTS

| | | | | |
|---|---|---|---|---|
| 6,005,305 | A * | 12/1999 | Turchi | 307/106 |
| 6,677,034 | B1 * | 1/2004 | Hooley et al. | 428/323 |
| 7,100,514 | B2 * | 9/2006 | LeBourgeois | 102/502 |
| 2001/0035690 | A1 * | 11/2001 | Kato et al. | 310/179 |
| 2002/0166924 | A1 * | 11/2002 | Fahey | 244/121 |
| 2005/0034593 | A1 * | 2/2005 | LeBourgeois | 89/1.11 |
| 2005/0088044 | A1 * | 4/2005 | Kekez et al. | 307/108 |

OTHER PUBLICATIONS

Tkach et al., *Theoretical Treatment of Explosive-Driven Ferroelectric Generators*, IEEE Transactions on Plasma Science, vol. 30, No. 5 (Oct. 2002).

Tkach et al., *Parametric and Experimental Investigation of the EDFEG*, IEEE 2002.

Shkuratov et al., *Experimental Study of Compact Explosive Driven Shock Wave Ferroelectric Generators*, IEEE 2002.

Setchell, *Shock Wave Compression of the Ferroelectric Ceramic* $Pb_{0.99}$ $(Zr_{0.95}$ $Ti_{0.05})_{0.98}$ $Nb_{0.02}$ $O_3$*: Depoling Currents*, Journal of Applied Physics 97, 013507, American Institute of Physics 2004.

Setchell, *Shock Wave Compression of the Ferroelectric Ceramic* $Pb_{0.99}$ $(Zr_{0.95}$ $Ti_{0.05})_{0.98}$ $Nb_{0.02}$ $O_3$*: Hugoniot States and Constitutive Mechanical Properties*, Journal of Applied Physics, vol. 94, No. 1, p. 573, American Institute of Physics 2003.

Schoeneberg et al.,*Ferromagnetic and Ferroelectric Materials as Seed Sources for Magnetic Flux Compressors*, IEEE 2003.

Lynse, *Dielectric Relaxation in Insulators Slightly Damaged by Stress Pulses*, J. Appl. Phys. 54 (6), Jun. 1983.

Lynse, *Electrical Response of Relaxing Dielectrics Compressed by Arbitrary Stress Pulses*, J. Appl. Phys. 54 (6), Jun. 1983.

Lynse, *Electrical Response of a Slim-Loop-Ferroelectric Ceramic Compressed by Shock Waves*, J. Appl. Phys. 49 (7), Jul. 1978.

Lynse, *Electrical Response of Relaxing Dielectrics Compressed by Shock Waves: The Axial-Mode Problem*, J. Appl. Phys. 49 (7), Jul. 1978.

Lynse, *Resistivity of Shock-Wave-Compressed PZT 95/5*, J. Appl. Phys. 48 (11), Nov. 1977.

Lynse, *Shock-Induced Polarization of a Ferroelectric Ceramic*, J. Appl. Phys. 48 (3), Mar. 1977.

Lynse et al., *Electric Energy Generation by Shock Compression of Ferroelectric Ceramics: Normal-Mode Response of PZT 95/5*, J. Appl. Phys. 48 (4), Apr. 1976.

Lynse, *Prediction of Dielectric Breakdown in Shock-Loaded Ferroelectric Ceramics*, J. Appl. Phys. 46 (1), Jan. 1975.

Lynse et al., *Electromechanical Response of PZT 65/35 Subjected to Axial Shock Loading*, J. Appl. Phys. 46 (1), Jan. 1975.

Lynse, *Dielectric Breakdown of Shock-Loaded PZT 65/35*, J. Appl. Phys. 44 (2), Feb. 1973.

Lynse et al., *Analysis of Shock-Wave-Actuated Ferroelectric Power Supplies*, Ferroelectrics, vol. 10, pp. 129-133, 1976.

Engel et al., *Compact Kinetic-to-Electrical Energy Conversion*, IEEE 1997.

Staines et al., *Compact Piezo-Based High Voltage Generator—Part I: Quasi-Static Measurements*, Electromagnetic Phenomena, 1993.

Staines et al., *Compact Piezo-Based High Voltage Generator—Part II: Quasi-Static Measurements*, Electromagnetic Phenomena, 1993.

Lynse, *Dielectric Properties of Shock-Wave-Compressed PZT 95/5*, J. Appl. Phys. 48 (3), Mar. 1977.

Lynse, *Kinetic Effects in the Electrical Response of a Shock-Compressed Ferroelectric Ceramic*, J. Appl. Phys. 46 (9), Sep. 1975.

* cited by examiner

EXPLOSIVE-DRIVEN ELECTRIC PULSE GENERATOR AND METHOD OF MAKING SAME

BACKGROUND

1. Field of the Invention

The present invention relates to an electric pulse generator and a method for making the electric pulse generator. In particular, the present invention relates to an explosive-driven electric pulse generator and a method for making the explosive-driven electric pulse generator.

2. Description of Related Art

High-voltage, electrical pulses are employed for many different uses. For example, such pulses may be used in defense, flash X-ray, oilfield logging, and oilfield radiography applications. While electrical pulses may be generated in many different ways, one way of producing such pulses is by mechanically impacting or shocking a material that exhibits a piezoelectric effect. Generally, these materials have a crystalline structure of non-centrosymmetric unit cells. When a mechanical stress is applied to such a material, an electrical charge is produced. The voltage of the electrical charge produced by mechanically stressing a piezoelectric material is proportional to the amount of mechanical stress applied to the material. Thus, if a high-voltage electrical charge is desired, a correspondingly large mechanical stress is applied to the piezoelectric material.

One way of generating a high-voltage electrical charge with a piezoelectric material is to impact the piezoelectric material with an explosive-driven member or with products (e.g., gases, particles, etc.) generated during detonation of an explosive material. FIGS. 1 and 2 illustrate two conventional apparatuses used to generate electrical pulses. In FIG. 1, an electric pulse generator 101 includes a piezoelectric material 103 disposed between and in electrical contact with a housing 105 and a receiver 107. Housing 105 defines a cavity 109 in which an explosive material 111 is disposed. Upon detonation of explosive material 111, the products of detonation urge piezoelectric material 103 toward receiver 107, mechanically stressing piezoelectric material 103. The electrical charge produced by piezoelectric material 103 is electrically conducted to housing 105 and to receiver 107, where it may be accessed via electrical leads 113, 115.

FIG. 2 depicts a conventional electric pulse generator 201 alternative to that shown in FIG. 1. Elements of electric pulse generator 201 generally correspond to those of electric pulse generator 101 (shown in FIG. 1) except that a projectile 203 is disposed between an explosive material 205 and piezoelectric material 103. Upon detonation of explosive material 205, the products of detonation propel projectile 203 toward and into impact with piezoelectric material 103. Projectile 203 mechanically stresses piezoelectric material 103, producing an electrical charge. The electrical charge is conducted to housing 105 and to receiver 107, where it may be accessed via electrical leads 113, 115.

Such conventional electric pulse generators, however, suffer from several problems. For example, the explosive arrangement may create a pressure pulse on detonation that is too short to sufficiently compress a thicker portion of piezoelectric material. Moreover, the explosive arrangement may produce a large peak pressure during the detonation pressure pulse, resulting in premature breakdown of the piezoelectric material. In either case, the resulting electrical pulse may exhibit a lower voltage than desired.

Further, typical conventional electric pulse generators comprise a relatively large portion of explosive material. Such electric pulse generators, therefore, must be handled carefully to avoid inadvertent detonation of the explosive material.

While there are many ways known in the art to produce a high-voltage electrical pulse, considerable room for improvement remains. The present invention is directed to overcoming, or at least reducing, the effects of one or more of the problems set forth above.

SUMMARY OF THE INVENTION

In one aspect of the present invention, an electric pulse generator is provided. The electric pulse generator includes a driver having an outer surface; a receiver; and one or more piezoelectric elements disposed between and in electrical contact with the driver and the receiver. The electric pulse generator further includes an explosive material disposed on the outer surface of the driver.

In another aspect of the present invention, an electric pulse generator is provided. The electric pulse generator includes a driver having an outer surface, the outer surface defining a substantially helical groove and a receiver. The electric pulse generator further includes one or more ferroelectric elements disposed between and in electrical contact with the driver and the receiver and a detonation cord disposed in the groove defined by the outer surface of the driver.

In yet another aspect of the present invention, a method of making an electrical pulse generator is provided. The method includes providing one or more piezoelectric elements, a driver, a receiver, and an explosive material; applying the explosive material to an outer surface of the driver; and electrically coupling the one or more piezoelectric elements between the driver and the receiver.

The present invention provides significant advantages, including: (1) the ability to apply pressure to the piezoelectric element or elements for a longer period of time, thus increasing the voltage outputted from the piezoelectric element or elements; (2) the ability to apply more consistent pressure to the piezoelectric element or elements, thus decreasing the likelihood of damage to the element or elements; and (3) the ability to tailor the electric pulse waveform depending upon the implementation.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
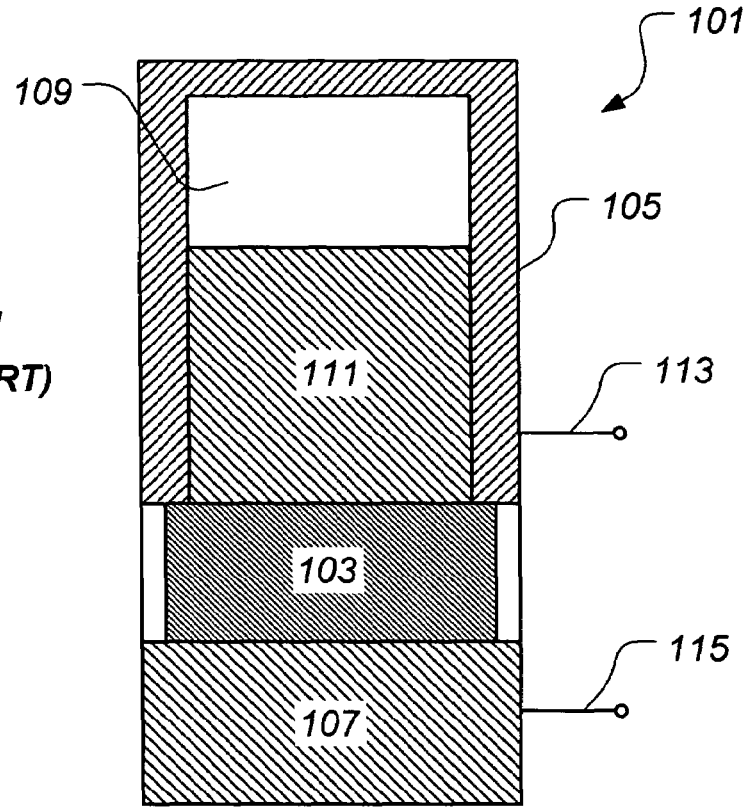
FIG. 1 (PRIOR ART)
FIG. 1 is a stylized, cross-sectional view of a first conventional electric pulse generator.
Figure 2:
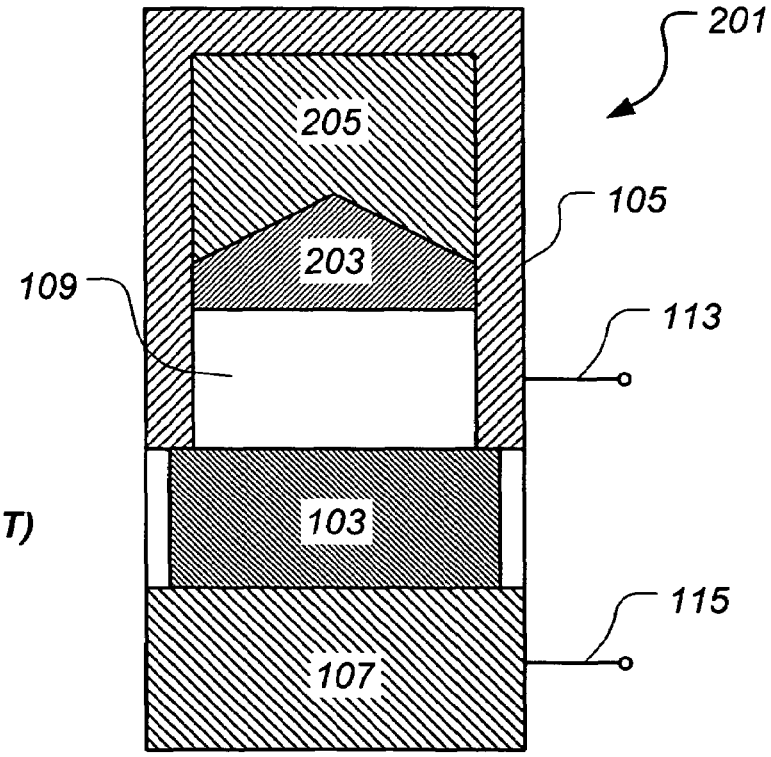
FIG. 2 (PRIOR ART)
FIG. 2 is a stylized, cross-sectional view of a second conventional electric pulse generator.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will, of course, be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an explosive-driven apparatus for generating an electrical pulse. In various implementations, the apparatus includes an explosive material disposed on an outer surface of a driver. When the explosive material is detonated, products resulting from the detonation urge the driver into increasing contact with a piezoelectric material. The piezoelectric material is compressed between the driver and a receiver, thus generating an electrical pulse.

Figure 3:
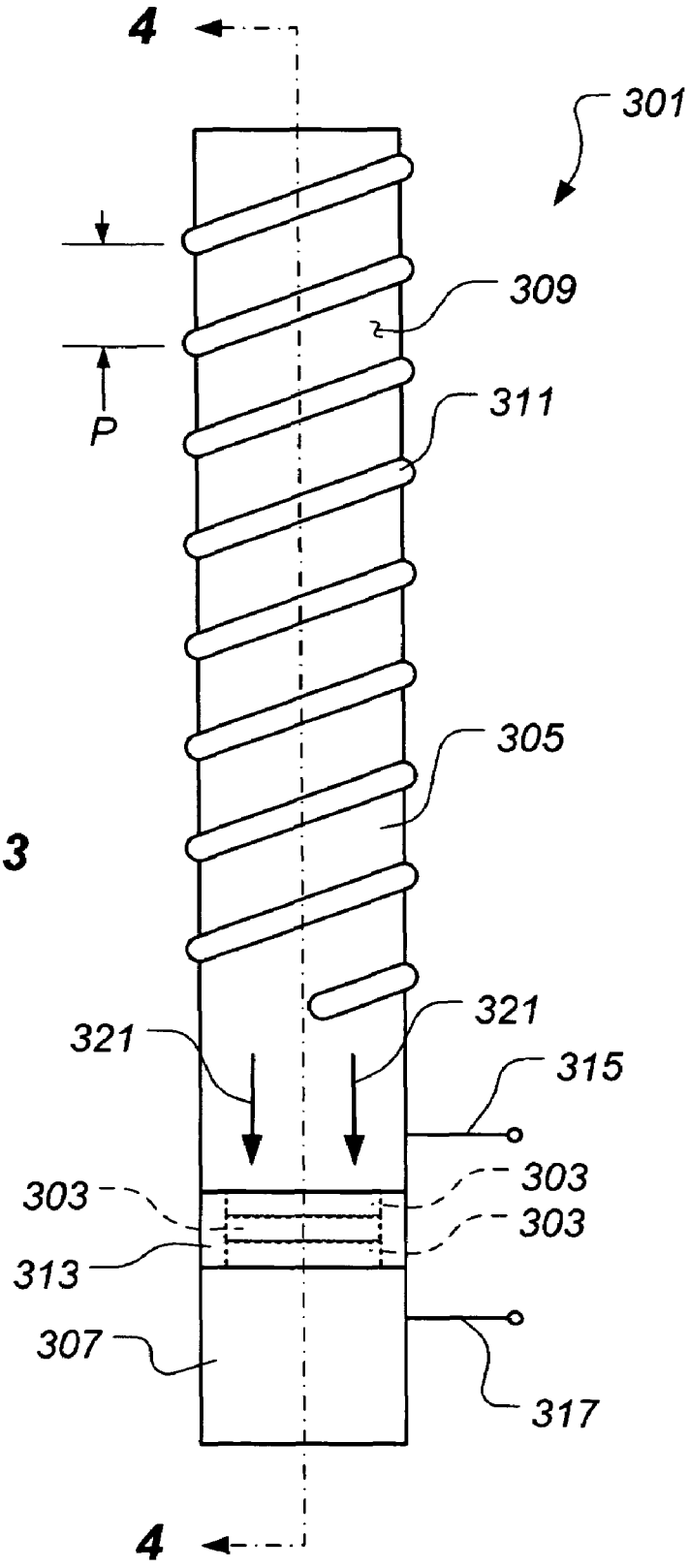
FIG. 3 is a side, elevational view of an illustrative embodiment of an electric pulse generator according to the present invention.
Figure 4:
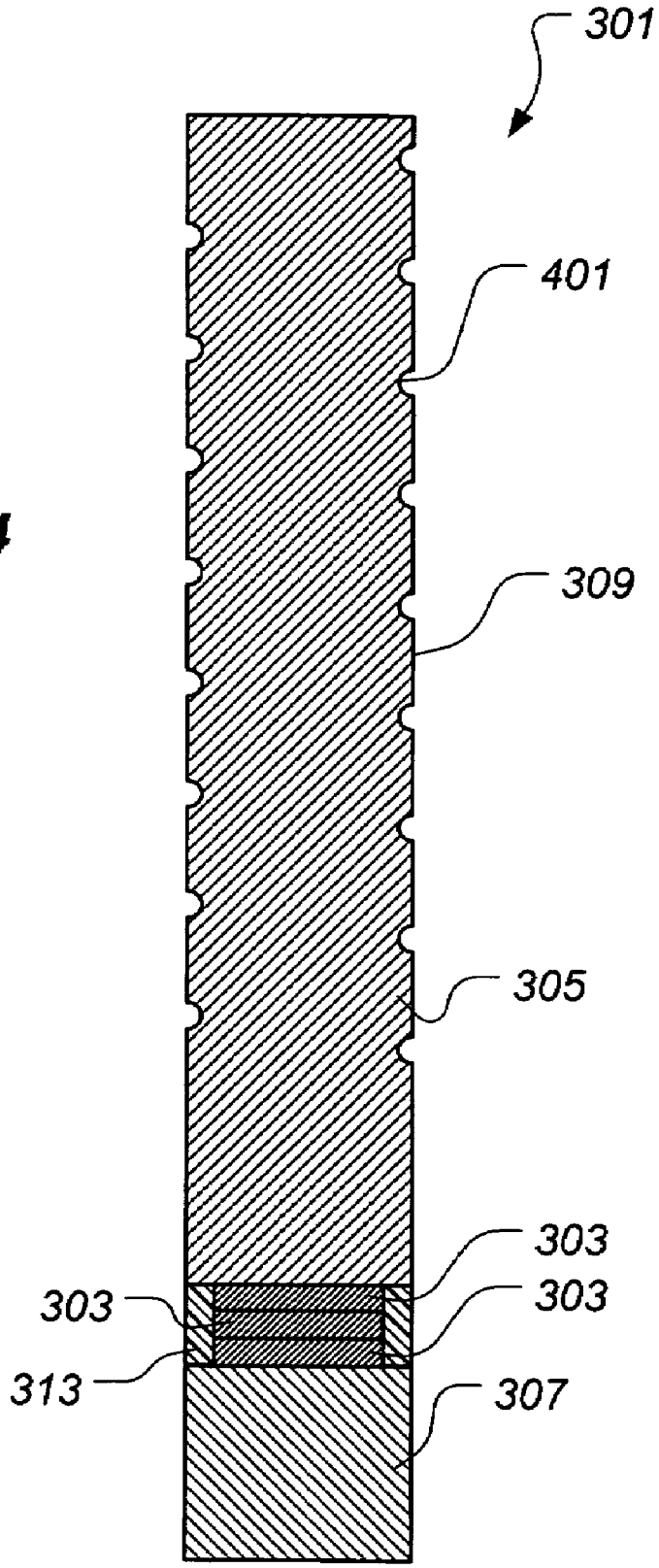
FIG. 4 is a cross-sectional view of the electric pulse generator of FIG. 3 taken along the line 4-4 of FIG. 3.

FIGS. 3 and 4 depict one particular illustrative embodiment of an explosive-driven electric pulse generator 301 according to the present invention. FIG. 3 presents a side view of generator 301, while FIG. 4 provides a cross-sectional view of generator 301 taken along the line 4-4 of FIG. 3. In the illustrated embodiment, generator 301 includes one or more piezoelectric elements 303 disposed between a driver 305 and a receiver 307. An outer surface 309 of driver 305 defines a groove 401, which is shown more clearly in FIG. 4 and extends helically along outer surface 309. An explosive material 311, which is only shown in FIG. 3, is disposed in helical groove 401. Note that explosive material 311 is not shown in FIG. 4 to better illustrate groove 401. A dielectric portion 313 is disposed around piezoelectric elements 303, between driver 305 and receiver 307. Electrical leads 315, 317 are electrically coupled with driver 305 and receiver 307, respectively, for accessing the electrical pulse generated by electric pulse generator 301.

When explosive material 311 is detonated, piezoelectric elements 303 are compressed by a resulting pressure wave traveling along the length of driver 305, as indicated by arrows 321 (only shown in FIG. 3). Piezoelectric elements 303 are, therefore, compressed between driver 305 and receiver 307. Piezoelectric elements 303 produce an electrical pulse as a result of being compressed, which can be accessed via leads 315, 317.

Still referring to FIGS. 3 and 4, features of various particular embodiments of electric pulse generator 301 will now be discussed. As indicated above, one or more piezoelectric elements 303 are disposed between driver 305 and receiver 307. It should be noted that any suitable number of piezoelectric elements 303 may be employed in the present invention. For example, only one piezoelectric element 303 may be included or a plurality of piezoelectric elements 303 may be utilized. It is generally desirable, although not required, for a plurality of piezoelectric elements 303 to be bonded along facing surfaces. In one particular embodiment, piezoelectric elements 303 are bonded along facing surfaces with a conductive epoxy, such as a conductive silver epoxy.

Generally, piezoelectric elements 303, or a single piezoelectric element 303 if only one is present, may comprise any material that exhibits a piezoelectric effect. In one particular embodiment, one or more of piezoelectric elements 303 comprise a ferroelectric material. Ferroelectric materials are a sub-class of piezoelectric materials that contain natural dipoles that can be reversed in the presence of a strong, external electric field. Ferroelectric materials tend to display a very strong piezoelectric effect but can be de-poled and lose their piezoelectric properties when subjected to high electric fields, high temperatures, or excessive pressures.

While many different ferroelectric materials may be utilized in the present invention, one particular class of ferroelectric materials conform to the formula $ABO_3$, wherein A is a large, divalent, metal ion and B is a tetravalent, metal ion. Examples of materials exhibiting large, divalent, metal ions are lead, strontium, and barium. Examples of materials exhibiting tetravalent, metal ions include titanium and zirconium. One particular ferroelectric material suitable for use as one or more of the piezoelectric elements 303 is $PbZrO_3$—$PbTiO_3$ solid solution, known as PZT. PZT is a polycrystalline ceramic comprising two ferroelectric materials, lead zirconate and lead titanate. PZT is a hard, dense material exhibiting a relatively strong piezoelectric effect and an extremely high electrical permittivity, in the range of about $1000\epsilon_0$ to about $3000\epsilon_0$. In one particular embodiment, piezoelectric elements 303 comprise the material EC-64 PZT from EDO Electro-Ceramic Products of Salt Lake City, Utah.

Still referring to FIGS. 3 and 4, driver 305 may comprise any suitable, conductive, solid material (i.e., not a gas or a fluid) and the selection of the particular material for driver 305 may be implementation specific. For example, the material comprising driver 305 may be selected depending upon the material's density, weight, electrical conductivity, acoustic properties, or the like, as one of ordinary skill in the art would appreciate having the benefit of the present disclosure. Driver 305 may, for example, comprise aluminum, an aluminum alloy, steel, or the like.

While driver 305 is depicted in FIGS. 3 and 4 as being substantially right cylindrical, the scope of the present invention is not so limited. Rather, driver 305 may take on any suitable shape, such as a frustum of a cone, a prism, or the like.

Outer surface 309 of driver 305, as depicted in FIGS. 3 and 4, defines groove 401 (shown only in FIG. 4) that is generally helical in form and semi-circular in cross-section. The scope of the present invention, however, is not so limited. Rather, groove 401, however, may take on other forms or cross-sectional shapes depending upon the characteristics of the electrical pulse generated by electric pulse generator 301. For example, in certain embodiments, outer surface 309 of driver 305 may define a groove 401 that is generally linear in form, extending generally along a length of driver 305. Moreover, groove 401 may exhibit a cross-sectional shape that is, for example, rectangular or angular, irrespective of the form of groove 401. It should be noted, however, that some embodiments of electric pulse generator 301 may omit groove 401, such that explosive material 311 is applied to outer surface 309 of driver 305.

Still referring to FIGS. 3 and 4, piezoelectric elements 303 are compressed between driver 305 and receiver 307 upon detonation of explosive material 311. While receiver 307 is depicted in FIGS. 3 and 4 as being generally right cylindrical, the scope of the present invention is not so limited. Rather, receiver 307 may comprise any shape suitable for receiver 307. For example, a portion of a structure housing electric pulse generator 301 may serve as receiver 307. Moreover, receiver 301 may comprise any of a wide variety of materials, particularly any conductive, solid material. Receiver 307 may, for example, comprise aluminum, an aluminum alloy, steel, or the like.

As discussed above, explosive material 311 is applied to outer surface 309 of driver 305. Explosive material 311 may comprise, for example, cast, putty, and extruded forms of materials containing cyclotrimethylene trinitramine (RDX), cyclotetramethylene tetranitramine (HMX), pentaerythritoltetranitrate (PETN), trinitrotoluene (TNT), or the like. Note that this particular list of explosive materials 311 is neither exhaustive nor exclusive. Moreover, explosive material 311 may take on the form of a detonating cord, such as "A-Cord" from Austin Powder of Cleveland, Ohio. In one particular embodiment, explosive material 311 is detonating cord comprising a nylon housing containing about five grams of PETN per meter of length and having a detonation velocity of about 6900 meters per second. Note that explosive material 311 may be detonated by any suitable means.

If groove 401 exhibits a helical form, a pitch P and the number of turns or revolutions of the helix can be varied to change certain electric pulse characteristics, such as the waveform shape of the electric pulse. Generally, a smaller pitch P results in a longer rise time to peak voltage, a higher peak voltage, and an overall longer pulse width. Generally, it is desirable that pitch P be tailored so that the longitudinal velocity of detonation along the length of driver 305 is proportional to the wave velocity (i.e., approximately the speed of sound) in driver 305. This proportion affects the amount of reinforcement and the length of the detonation wave, determining the shape and magnitude of the wave incident upon the piezoelectric elements 303. For example, this relationship may be expressed as:

$$VOD_z := \frac{VOD}{\sqrt{(P)^2 + (C)^2}} \cdot P,$$

wherein P represents the pitch of groove 401 (and explosive material 311), C represents the circumference of driver 305, and VOD represents the velocity of detonation of explosive material 311. When $VOD_z$ is substantially equal to the wave velocity in driver 305, the explosive wave-fronts impact piezoelectric elements 303 at approximately the same time, creating a short but powerful pressure pulse. If, however, $VOD_z$ is slower than the wave velocity in driver 305, a longer, weaker pulse may be produced.

Moreover, it is generally desirable, that the time of detonation is longer than the time required for the detonation wave to propagate through the one or more piezoelectric elements 303. For example, this relationship can be expressed as:

$$\frac{t_{pulse}}{t_{piezo}} > 1,$$

wherein $t_{pulse}$ represents the time of detonation and $t_{piezo}$ represents the time required for the detonation wave to propagate through the one or more piezoelectric elements 303.

The time of detonation ($t_{pulse}$) may be represented by:

$$t_{pulse} = \frac{\sqrt{(P)^2 + (C)^2}}{VOD} \cdot N_{turns},$$

wherein P represents the pitch, C represents the circumference of driver 305, VOD represents the velocity of detonation of explosive material 311, as discussed above, and $N_{turns}$ represents the number of turns of explosive material 311.

The time required for the detonation wave to propagate through the one or more piezoelectric elements ($t_{piezo}$) may be represented by:

$$t_{piezo} = \frac{N_{piezo} \cdot T_{piezo}}{V_{sound\ in\ piezo}},$$

wherein $N_{piezo}$ represents the number of piezoelectric elements 303, $T_{piezo}$ represents the thickness of each piezoelectric element 303, and $V_{sound\ in\ piezo}$ represents the velocity of sound in the material of the piezoelectric elements 303.

Dielectric portion 313 is provided between driver 305 and receiver 307, about piezoelectric elements 303, to inhibit surface flashover between driver 305 and receiver 307 along piezoelectric elements 303. The occurrence of surface flashover generally inhibits the peak voltage produced by piezoelectric elements 303 and, thus, is typically undesirable. In one embodiment, materials suitable for use as dielectric portion 313 are those that are capable of holding off a voltage corresponding to about the breakdown voltage of the piezoelectric elements 303. Moreover, suitable dielectric materials include materials that are capable of curing in deep crevices to completely encapsulate piezoelectric elements 303, exhibit adequate surface adhesion, and can be prepared with a minimal amount of air bubbles or other features that can cause electric field enhancements. It is also desirable to employ a dielectric material that cures at near room-temperature, since some piezoelectric materials may become de-poled when subjected to elevated temperatures. Examples of such dielectric materials include polyurethanes, polystyrenes, epoxies, transformer oils, silicone rubbers, and the like.

For example, dielectric portion 313 may comprise RTV11 two-part silicone rubber from GE Silicones of Wilton, Conn. Primers may be applied to the piezoelectric elements 303, driver 305, and/or receiver 307 prior to applying the dielectric material to aid in adhesion of the dielectric material. For example, S4155 primer from GE Silicones may be used prior to applying the RTV11 silicone rubber as the dielectric material. Other materials that may be suitable as dielectric portion 313, depending upon the particular implementation, include Hysol® E40FL two-part epoxy from Loctite Corporation of Rocky Hill, Conn. and Univolt N61B transformer oil from Exxon Mobil Corporation of Fairfax, Va. Other suitable materials include 3145-RTV and IS808 silicone rubbers from GE Silicones.

One particular preferred embodiment of electric pulse generator 301 is described below and in reference to FIGS. 5-8. It should be noted that the scope of the present invention is not limited to the particular characteristics of this embodiment. In this embodiment, electric pulse generator 301 includes one or more piezoelectric elements 303 disposed between and in electrical contact with a solid, aluminum, right cylindrical driver 305 and a solid, stainless steel, right cylindrical receiver 307. Facing surfaces of piezoelectric elements 303, driver 305, and receiver 307 are adhesively bonded by a conductive silver epoxy. In this embodiment, driver 305 has an outside diameter of about 2.5 centimeters and receiver 307 has an outer diameter of about seven centimeters, although these dimensions can vary depending upon the implementation. Driver 305 has a length of about 15.2 centimeters and receiver 307 has a length of about 15.2 centimeters. Groove 401, defined by outer surface 309 of driver 305, has a helical form and exhibits a width and depth of about 4.8 millimeters. Explosive material 311 comprises A-Cord detonating cord having an about 4.2 millimeter nylon housing containing about five grams of PETN per meter of length. Dielectric portion 313 comprises S4155 primer and RTV11 silicone rubber from GE Silicones. Possible outputs of this particular embodiment of electric pulse generator 301 are provided below.

Figure 5:
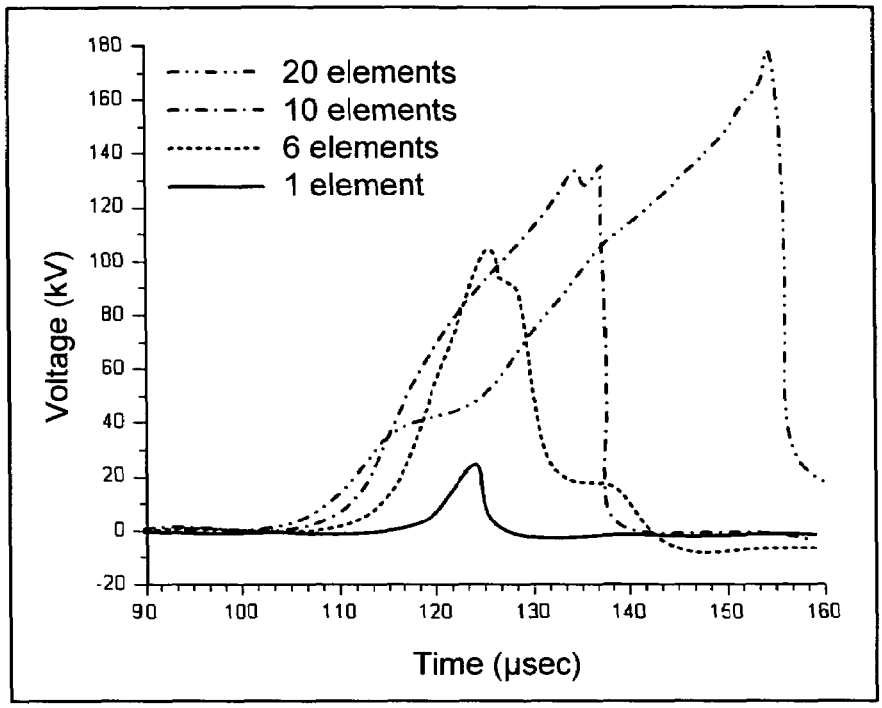
FIG. 5 is graphical representation of illustrative waveforms for embodiments of the electric pulse generator of the present invention having varying numbers of piezoelectric elements.

FIG. 5 illustrates possible outputs for electric pulse generator 301 described above when varying the number of piezoelectric elements 303. FIG. 5 presents voltage-time graphs representing electrical pulses generated by electric pulse generator 301 having one, six, ten, and 20 substantially round piezoelectric elements 303. In each case, each piezoelectric element 303 is about five millimeters thick and about 25 millimeters in diameter. In the embodiment comprising a single piezoelectric element 303, driver 305 defines helical groove 401 having a pitch of about 25 millimeters and including three revolutions about driver 305, beginning at the top revolution (i.e., distal to piezoelectric elements 303). The six and ten piezoelectric element 303 embodiments include driver 305 defining helical groove 401 having a pitch of about 16.9 millimeters and six revolutions about driver 305, beginning at the top revolution. The 20 piezoelectric element 303 embodiment includes driver 305 defining helical groove 401 having a pitch of about 12.7 millimeters and 12 revolutions beginning at the top revolution.

In each of these embodiments, piezoelectric element 303 or piezoelectric elements 303 are compressed or excited using A-cord detonating cord as explosive material 311 disposed in helical groove 401. FIG. 5 shows the output voltage and the duration of the pulse increases as the number of piezoelectric elements 303 is increased. Note that more explosive material 311 is used for greater numbers of piezoelectric elements 303 to provide adequate compression of piezoelectric elements 303.

Figure 6:
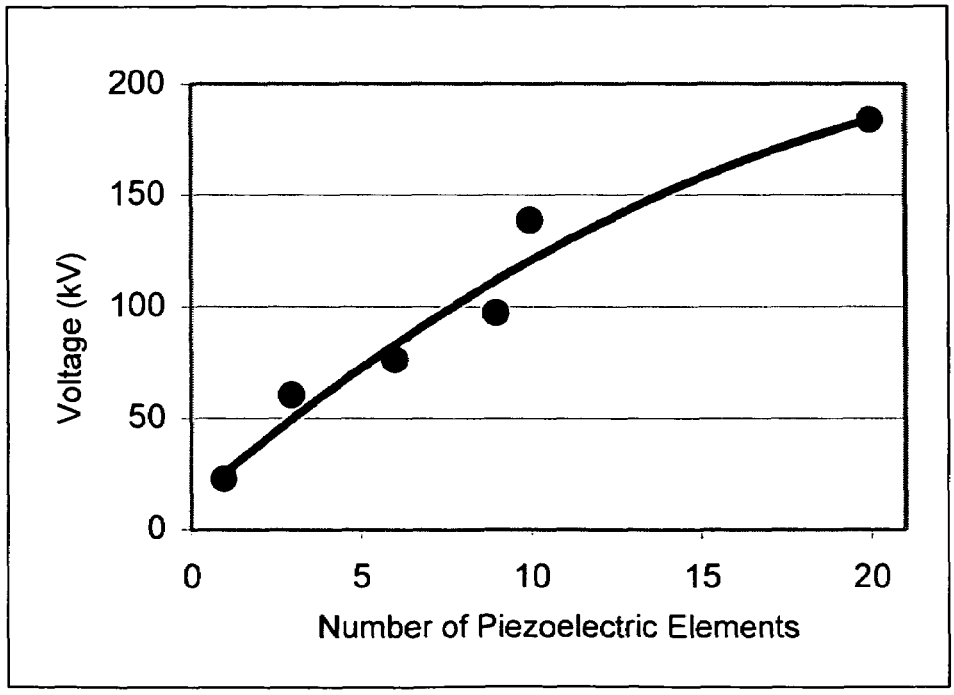
FIG. 6 is a graphical representation of illustrative output voltages for embodiments of the electric pulse generator of the present invention having varying numbers of piezoelectric elements.

FIG. 6 illustrates a comparison of average voltages produced by embodiments of electric pulse generator 301 having varying numbers of piezoelectric elements 303, as described above in relation to FIG. 5. Each data point represents an embodiment having a particular number of piezoelectric elements 303 having thicknesses of about five millimeters and diameters of about 25 millimeters. As the number of piezoelectric elements 303 is increased, the output voltage per piezoelectric element 303 is reduced, while the overall output voltage increases.

Figure 7:
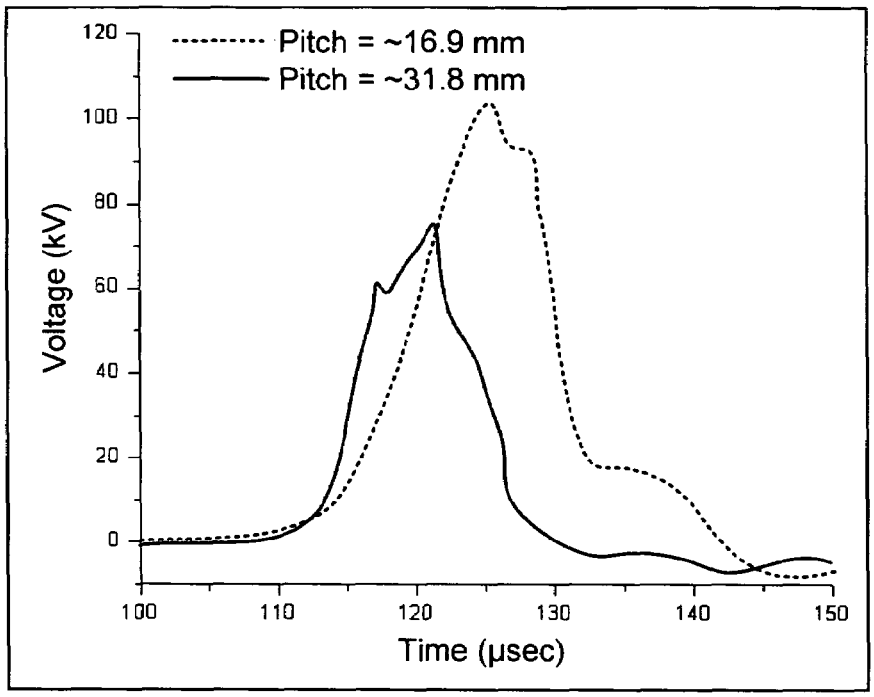
FIG. 7 is a graphical representation of illustrative waveforms for embodiments of the electric pulse generator of the present invention having explosive materials with varying helical pitches.

As illustrated in FIG. 7, varying the pitch of the helical driver results in varying rise times as well as changes in peak voltage. In particular, FIG. 7 depicts a comparison of waveforms generated by embodiments of electric pulse generator 301 having six piezoelectric elements 303, each of about 5 millimeters in thickness and about 25 millimeters in diameter. As can be seen in FIG. 7, increased pitch of helical groove 401 and explosive material 311 results in faster rise time but lower output voltage.

Figure 8:
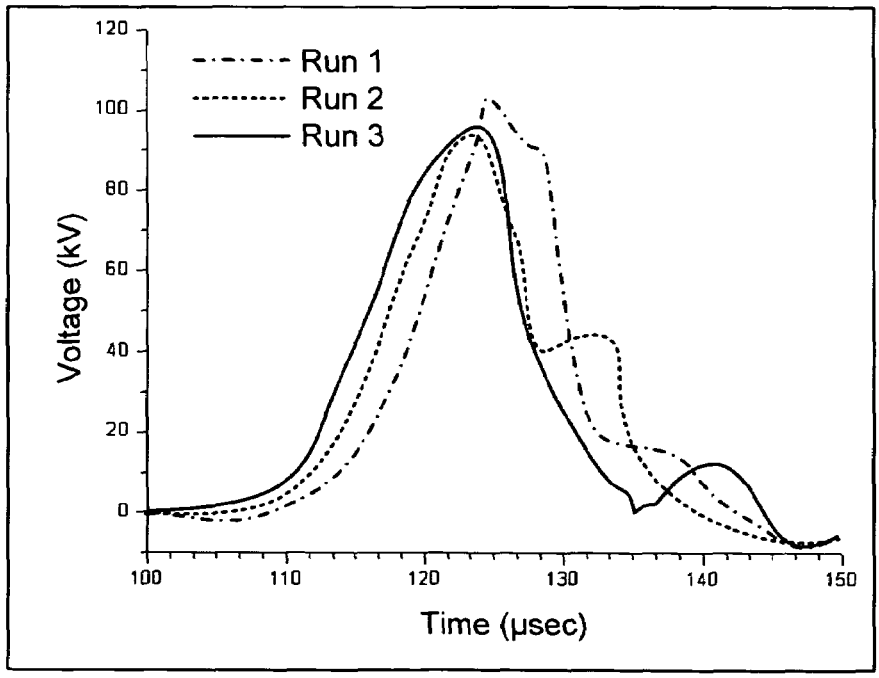
FIG. 8 is a graphical representation of illustrative waveforms for substantially equivalent electric pulse generators according to the present invention.

It should be noted that output voltages of substantially equivalent electric pulse generators 301 are substantially equivalent. In other words, the output voltage of a particular embodiment of electric pulse generator 301 is reproducible. FIG. 8 illustrates waveforms for three substantially equivalent electric pulse generators 301. Each electric pulse generator 301 includes six piezoelectric elements 303 and a driver 305 defining a helical groove 401 with a pitch of about 16.9 millimeters. In this embodiment, three revolutions of A-cord detonating cord are disposed in helical groove 401, beginning at the top revolution (i.e., distal to piezoelectric elements 303). In FIG. 8, the waveforms are offset in time to avoid overlap and to better illustrate similar rising edges and peak voltages.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An electric pulse generator, comprising:

a cylindrical driver having a first end, a second end, and an outer surface extending between the first end and the second end;

a receiver;

one or more piezoelectric elements disposed between and in electrical contact with the driver and the receiver; and an explosive material disposed on the outer surface of the driver.

2. The electric pulse generator according to claim 1, wherein the outer surface of the driver defines a groove and the explosive material is disposed in the groove.

3. The electric pulse generator according to claim 2, wherein the groove helically extends along the outer surface.

4. The electric pulse generator according to claim 1, wherein the driver has a generally right cylindrical form.

5. The electric pulse generator according to claim 1, wherein at least one of the driver and the receiver are bonded to the one or more piezoelectric elements by a conductive epoxy.

6. The electric pulse generator according to claim 1, wherein the one or more piezoelectric elements includes a plurality of piezoelectric elements bonded on facing surfaces by a conductive epoxy.

7. The electric pulse generator according to claim 1, wherein the explosive material comprises:

at least one of cyclotrimethylene trinitramine, cyclotetramethylene tetranitramine, pentaerythritoltetranitrate, and trinitrotoluene.

8. The electric pulse generator according to claim 1, wherein the explosive material is detonating cord.

9. The electric pulse generator according to claim 1, wherein at least one of the one or more piezoelectric elements comprises:

a ferroelectric material.

10. The electric pulse generator according to claim 9, wherein the ferroelectric material conforms to the formula $ABO_3$, wherein A is a large, divalent metal ion and B is a tetravalent, metal ion.

11. The electric pulse generator according to claim 9, wherein the ferroelectric material comprises:

at least one of lead zirconate and lead titanate.

12. The electric pulse generator according to claim 9, wherein the ferroelectric material comprises:

a $PbZrO_3$—$PbTiO_3$ solid solution ceramic.

13. The electric pulse generator according to claim 1, wherein at least one of the one or more piezoelectric elements has an electrical permittivity within a range of about $1000\epsilon_0$ to about $3000\epsilon_0$.

14. The electric pulse generator according to claim 1, further comprising:

a dielectric portion disposed between the driver and the receiver about the one or more piezoelectric elements.

15. The electric pulse generator according to claim 14, wherein the dielectric portion comprises:

a material capable of holding off a voltage corresponding to about a breakdown voltage of the one or more piezoelectric elements.

16. The electric pulse generator, according to claim 14, wherein the dielectric portion comprises:

one of a polyurethane, a polystyrene, an epoxy, a transformer oil, and a silicone rubber.

17. An electric pulse generator, comprising:

a cylindrical driver having a first end, a second end, and an outer surface extending between the first end and the second end, the outer surface defining a substantially helical groove;

a receiver;

one or more ferroelectric elements disposed between and in electrical contact with the driver and the receiver; and a detonation cord disposed in the groove defined by the outer surface of the driver.

18. A method of making an electrical pulse generator, comprising:

providing one or more piezoelectric elements, a cylindrical driver, a receiver, and an explosive material, the driver having a first end, a second end, and an outer surface extending between the first end and the second end;

operably associating the explosive material with the outer surface of the driver; and electrically coupling the one or more piezoelectric elements between the driver and the receiver.

19. The method according to claim 18, wherein the step of operably associating the explosive material with the outer surface of the driver comprises:

applying the explosive material in a helical form to the outer surface of the driver.

20. The method according to claim 19, wherein the step of operably associating the explosive material with the outer surface of the driver comprises:

determining at least one of a pitch and a number of revolutions for the explosive material depending upon a desired output of the electrical pulse generator.

21. The method according to claim 18, further comprising:

disposing a dielectric portion between the driver and the receiver about the one or more piezoelectric elements.

* * * * *